United States Patent [19]

Trevillion

[11] Patent Number: 4,791,988

[45] **Date of Patent: * Dec. 20, 1988**

[54] PERMANENT ANCHOR FOR USE WITH THROUGH TUBING BRIDGE PLUG

[75] Inventor: William L. Trevillion, Houston, Tex.

[73] Assignee: Halliburton Company, Duncan, Okla.

[ * ] Notice: The portion of the term of this patent subsequent to Jun. 9, 2004 has been disclaimed.

[21] Appl. No.: 29,004

[22] Filed: Mar. 23, 1987

[51] Int. Cl.[4] ..... E21B 33/124

[52] U.S. Cl. ..... 166/285; 166/133; 166/386

[58] Field of Search ..... 166/69, 117, 123, 133, 166/134, 135, 188, 192, 202, 205, 386, 387

[56] References Cited

U.S. PATENT DOCUMENTS

| | | | |
|---|---|---|---|
| 3,064,734 | 11/1962 | Toeke | 166/202 X |
| 3,282,347 | 11/1966 | Chenoveth | 166/202 X |
| 3,460,624 | 8/1969 | Aitken et al. | 166/387 X |
| 3,891,034 | 6/1975 | Owen et al. | 166/285 |
| 4,671,356 | 6/1987 | Barker et al. | 166/285 |

*Primary Examiner*—Stephen J. Novosad
*Assistant Examiner*—William P. Neuder
*Attorney, Agent, or Firm*—William J. Beard

[57] ABSTRACT

A through tubing bridge plug is disclosed. In the preferred and illustrated embodiment, a central hollow tube having a passage therein supports the external parts. The central passage terminates top and bottom with openings or passages. At the top end, a sleeve valve mechanism originally pinned in an open position is installed. When the installation is completed, the sleeve valve is closed by a sequence of operations to permanently close the flow path. The device is set and anchored by applying a relative downward force to an external sleeve thereby deploying multiple link toggle means to lock the device in location, additionally deploying a upwardly facing petal basket to receive a charge of sand and cement to form a plug, and also deploying a centralizer. The device is installed at a specified elevation by anchoring the toggle means to prevent movement, deploying the petal basket to hold sand and cement for curing, locating the device in the casing by a centralizer, and bypassing fluid around the curing sand and cement through a central tubing opening below and above the uncurred materials. The final step includes closing a sleeve valve means to prevent further flow through the device.

16 Claims, 3 Drawing Sheets

PERMANENT ANCHOR FOR USE WITH THROUGH TUBING BRIDGE PLUG

BACKGROUND OF THE DISCLOSURE

A through tubing bridge plug (TTBP hereinafter) is a structure which is typically placed in a producing well to isolate the lower portions of the well from upper portions of the well. In a typical case, a tubing string delivering production fluids from lower portions of the well is selectively plugged to isolate lower portions of the well. This might occur in one instance where a lower horizon is producing great quantities of water but is not otherwise commercially valuable because it is producing excessive water. Often, there will be high horizons of interest which can produce oil and gas in commercial paying quantities. In this instance, a TTBP will be positioned at a selected depth in the well. In effect, it forms a permanent plug which isolates the lower portions of the well. This then enables the well to be reconfigured to obtain production from the higher horizon.

In the foregoing exemplary problem, the TTBP is positioned at the selected depth and is anchored there. In the ordinary course, installation of a TTBP requires that the device be located at a specific depth in the well. When so located, it must hold that location or depth. Typically, it must hold for several hours, perhaps as long as 36 hours. This is necessary so that time will permit sand and cement to be added above the TTBP to form the plug. Moreover, it must cure, the curing requiring several hours. Curing must be accomplished notwithstanding flow of well fluid from the formations below the TTBP. Fortunately, the TTBP has a bypass flow route in the way of a controllable valve connector to end a tubing through the TTBP. As an example, the TTBP is installed at the requisite horizon whereupon a multileaf basket is deployed, opening upwardly, to receive sand and cement in the basket. The tubing extends up through and past the basket. The tubing has openings below the basket to receive well fluid from below which fluid is conducted upwardly through the tubing and past the basket. This provides pressure relief so that pressure does not build up below the TTBP until after the cement has cured. The tubing thus is selectively opened and closed by a valve installed in the tubing.

The closure of the valve and hence blocking flow from horizons below the TTBP creates a pressure differential acting across the area of the tubing, thereby creating a force which may move the TTBP. The present apparatus sets forth a TTBP anchor system which anchors so that the plug will not be moved, nor the TTBP dislodged. The present apparatus thus provides a positive mechanical anchor which expands within the anchor, taking a bite in the tubing and having a toggle action which assures that the anchor will hold both at the time of installation before the plug cures and long thereafter. In the present apparatus, the anchor is located below the basket in the preferred embodiment to centralize and anchor the basket thereabove. This fixes in a concentric location the tubing extending upwardly through the TTBP basket. This apparatus is deployed by forcing a toggle link arrangement radially outwardly against the wall of the tubing. This assures that the device can then be left because the toggle links will deflect and deploy serrated teeth which bite into the tubing wall. The toggle links are held into this position by means of a spring bearing on the toggle mechanism, the spring holding even after the TTBP has been left in place. A method of operation utilizing the toggle mechanism is also disclosed.

In general terms, there is very little gripping accomplished by a cured plug formed above a TTBP. It is possible for the entire plug to slip. As described above it is possible to set a toggle type anchor below the TTBP which accomplishes a strong grip with the surrounding casing. In addition to that, the anchor of the present disclosure can be replicated at multiple locations above the TTBP. Perhaps some discussion would assist in this. As one example, consider a plug which is exposed to a significant differential pressure which might otherwise cause the cured plug to move. The toggle type mechanism described above is set below the TTBP. In addition to that, one or more of the toggle mechanisms can be placed at spaced locations above the TTBP and the first plug which is formed. By placing additional quantities of materials above the first cast, several toggle mechanisms can be submerged in the completed plug. The completed plug after several pours might be quite long and can encase one or more toggle mechanisms which lock the completed plug in location. The toggle mechanism thus functions as a separate or isolated anchor which is cast in place to secure the plug against high pressure differentials which might otherwise force the plug to break free of the grip.

An important advantage arises from this. One weakness of such a toggle mechanism arises in the long linkages which are required to achieve the set position. These long linkages are subject to buckling. That is, the failure mode is buckling rather than failure in compression or tension of the structural members. Once the plug is cast around them, buckling is prevented by the cast member. Accordingly, the toggle mechanism will endure much longer and hold against greater forces in the well.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
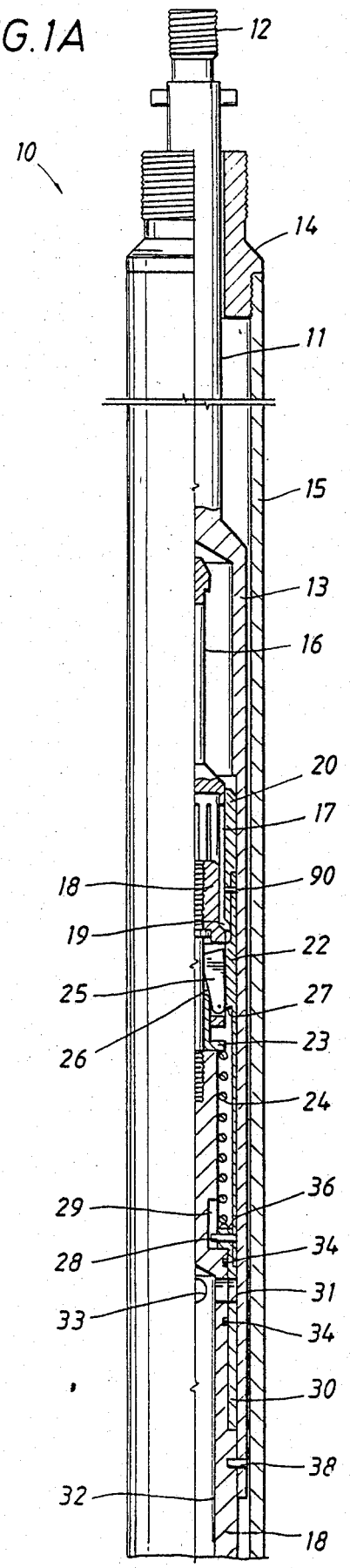
FIGS. 1A, 1B, 1C and 1D in sequence disclose in sectional view the TTBP of the present disclosure incorporating a toggle mechanism serving as an anchor to position the TTBP in a tubing for plugging a well.
Figure 1B:
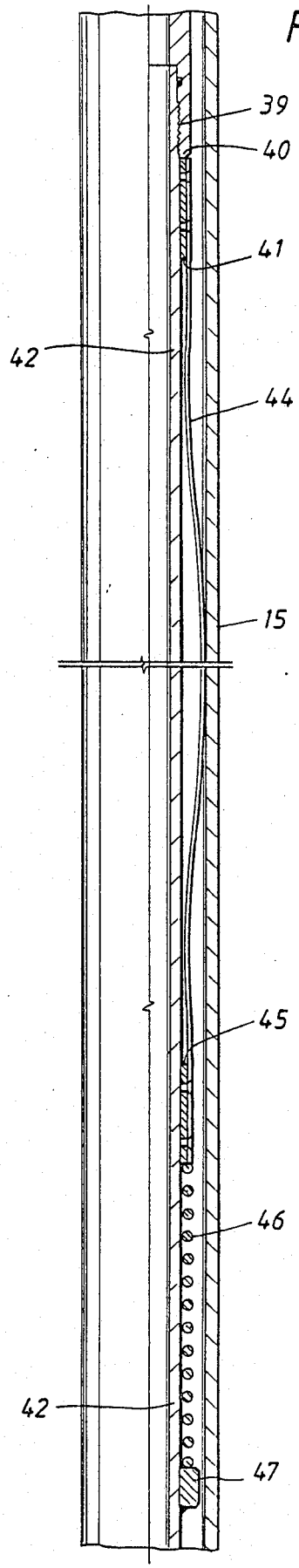

Thus, the structure shown in FIGS. 1A, 1B and most portions of 1C are the same as illustrated and described in application Ser. No. 846,404 filed Mar. 31, 1986. The description of the apparatus will thus use the same reference numerals found in the upper portions of the TTBP, disclosed in the running condition in FIG. 1 made of the four specific drawings. FIG. 2 is a contrasted view showing the TTBP after the anchor portion has been set. FIG. 2 should be contrasted primarily with the deployment of the tool in the running condition in FIG. 1D. Beginning the description at the upper end of the device and incorporating the description of the common subject matter from the referenced disclosure, one will note that the TTBP 10 includes a central mandrel 11 equipped with a threaded neck 12 to be connected with a running tool (not shown). The typical running tool (Model 05 by Baker Oil Tools) utilizes a gas generating powder charged creating relative motion between the outer and inner mandrels. Thus, the running tool is attached at the threads 12. The mandrel 11 terminates at the hollow elongate sleeve 13 therebelow. The sleeve 13 encloses apparatus that will be described. Separately, a collar 14 is positioned around the mandrel for telescoping movement thereon. The collar 14 is attached at its upper end by threaded engagement to the wireline supported pressure setting assembly. The lower end of the collar is threaded to a larger diameter, axially hollow sleeve 15. The sleeves 13 and 15 are concentric to one another. The sleeve 13 is relatively short in contrast with the sleeve 15. The sleeve 15 is quite long, enclosing certain centralizer components as will be described hereinafter.

In operation, a sequence of operations is conducted whereby the sleeves 13 and 15 are pulled upwardly. The sleeve 15, being much longer, is pulled upwardly to enable deployment of a centralizer to be described. The sleeve 13 is pulled upwardly and removed to expose a fishing neck. The operative steps relating to this sequence of operations will be described in detail hereinafter. The sleeves 13 and 15 thus enable the equipment to be run into the cased well to any depth prior to setting. The sleeves 13 and 15 are important to operation of the device; the sequence in which they are removed triggers certain operational steps.

The TTBP carries an upwardly directed fishing neck 16 which is temporarily enclosed and housed within the sleeve 13. The fishing neck will later be separated from the remainder of the equipment. To this end, the fishing neck 16 connects with a set of collet fingers 17. The collet fingers are forced radially outwardly by a plug 18 positioned in the collet fingers which have a surrounding bottom peripheral enlargement 19 which locks adjacent an internal upset shoulder on a locking sleeve 20. The sleeve 20 is sized to surround the fishing neck. The fishing neck is thus held in the illustrated location of FIG. 1 by the enlargement 19. The enlargement 19 abuts against the shoulder and is held in this position so long as the plug 18 is in the position shown in FIG. 1A. The plug 18 will later be pulled relatively downwardly to enable the enlargement 19 to deflect radially inwardly, thereby enabling the collet fingers to deflect inwardly for retrieval of the fishing neck 16. In the event the plug 18 will not move (due to cement contamination), a set of shear pins 90 will shear allowing the fishing neck 16 and sleeve 20 to release.

The sleeve 20 is pinned to a continuing sleeve 22 by the shear pins 90. The sleeve 22 has an internal portion (somewhat thicker) to define a cooperative shoulder surrounding the enlargement 19 as shown in FIG. 1A. The sleeve 22 encloses a spring driven, setting wedge cooperative with a set of dogs. Considering this in greater detail, the plug 18 supports a cylindrical wedge 23, the wedge being rested against an upwardly facing shoulder on the plug. A spring 24 forces the wedge upwardly. The spring is shown in the relaxed condition in FIG. 1. The wedge 23 includes an upstanding tapered skirt which contacts several pivoted dogs 25. The several dogs are mounted in slotted windows 26 that are an integral part of the plug 18. The dogs are tapered as shown in FIG. 1, having an inside face which is operatively contacted by the wedge 23. This enables the dogs to be driven outwardly. In FIG. 1A, the wedges are retracted. They are clamped in position by the surrounding sleeve 22. This is the position sustained during running in the well. The surrounding sleeve 22 holds the dogs radially inwardly as shown in FIG. 1A. On release the dogs 25 pivot through the slotted windows 26. In a typical installation, three or four dogs will suffice to obtain locking. The dogs include an outer face ending at a sharp upper corner. This upper corner locks against a shoulder 27 on the interior of the sleeve 22. As shown in FIG. 1A, the dogs are in a collapsed position away from the shoulder 27. The dogs must be moved relatively downwardly to enable the dogs to rotate outwardly under action of the tapered wedge 23. This movement is prevented by a shear pin 28. The pin 28 fastens the outer sleeve 22 to the apparatus on the interior of that sleeve. The shear pin 28 is fixedly held in a drilled hole accommodating the shear pin pressed into the hole in the sleeve 22. The opposite end of the shear pin is received in a lengthwise slot 29 formed in the plug 18. It will be observed that the plug 18 is made of multiple components for ease of manufacture, the plug nevertheless being slotted at 29. The slot has a finite length to enable some movement before shearing the pin 28. This range of movement (slot length) is important during setting of the tool to accommodate elongation and subsequent recoil of the components. The range of movement prevents premature shear of the pin 28 during the setting process.

The sleeve 22 is joined by the shear pin 28 to a valve sleeve 30. The valve sleeve 30 is formed with one or more valve ports 31. The valve sleeve 30 fits around the plug 18, the elongate plug being somewhat larger in diameter to enclose an internal passage 32. The passage 32 extends along the length of the plug 18 below a lateral port 33 which is aligned with the valve port 31. These ports define a flow path which extends to the very bottom of the apparatus 10 to bypass centralizers, the petal basket, and the mechanical anchor therebelow, all as will be described. Communication between the valve ports 31 and 33 is sealed by flanking O-ring seals 34. The seals above and below the two ports just mentioned assure a fluid flow path in the position shown in FIG. 1A but the seals block that flow path when the valve sleeve 30 is moved upwardly. The valve sleeve 30 has an upper shoulder 36 which abuts the coil spring 24 shown relaxed in FIG. 1A. The spring is compressed during operation to assure that the wedge 23 drives under the dogs 25, thereby deflecting them radially outwardly into the locking position against the shoulder 27.

After the sleeves 13 and 15 which surround the sleeve valve mechanism just described are removed, the port 31 is exposed and thereby open. In the running position shown in FIG. 1A, the port 31 is covered by the sleeves. This flow path through the port 31 is opened controllably after installation of the TTBP 10. As a subsequent step, the valve is closed by moving the valve sleeve 30 upwardly to close the port 31. This setting movement is prevented by a pin 38 which must be sheared in a particular sequence in conjunction with the shear pin 38. This operation will be described in detail hereinafter.

As stated earlier, the plug 18 is assembled from several components for ease of manufacture. The components are threaded together to define the plug 18. At this juncture, it is perhaps better to note that the plug is now axially hollow, enclosing the passage 32. As mentioned earlier, the plug is made of relatively thick walled tubular members joining at the threaded connection 39 (See FIG. 1B). This defines a downwardly facing shoulder 40 which abuts a sleeve 41 around a central tube 42. The tube 42 extends the passage 32 towards the lower portion of the apparatus as will be described. The sleeve 41 anchors the upper end of several centralizer wires 44. The centralizer wires are anchored at the upper end to enable them to deflect outwardly in a bow shape. The sleeve 15 captures the centralizer wires 44. They are clamped inwardly against deflection. The centralizer wires 44 are anchored at the upper end at the surrounding sleeve 41 and are secured at the lower end with a similar sleeve 45. The centralizer sleeves 41 and 45 slide on the tube 42. A compressed coil spring 46 forces the centralizer upwardly, thereby creating bowing deflection of the wires. This bowing is forbidden during running of the tool 10. The spring 46 is shown compressed in FIG. 1B. It shoulders against a ring 47 around the tube 42. All of these components are initially surrounded by the release sleeve 15 as shown in FIGS. 1A and 1B.

Figure 1C:
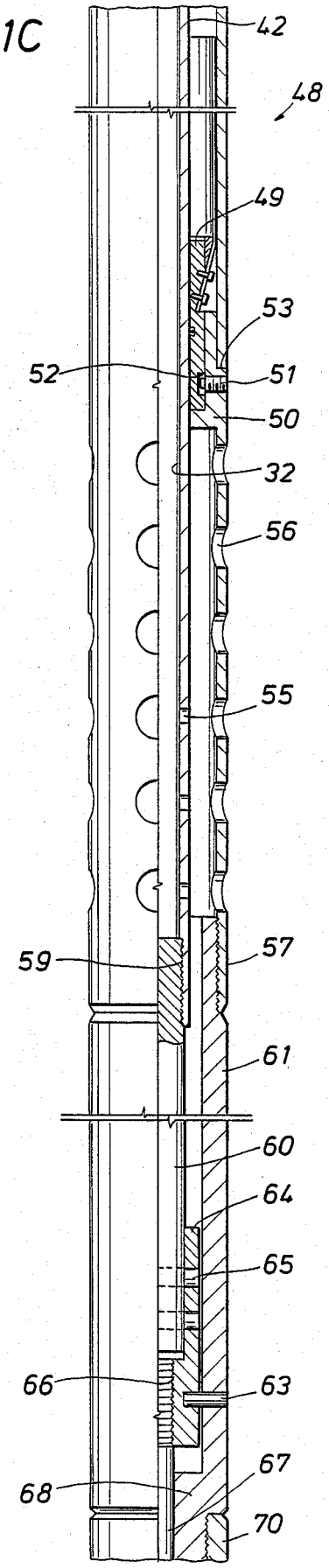
Figure 2:
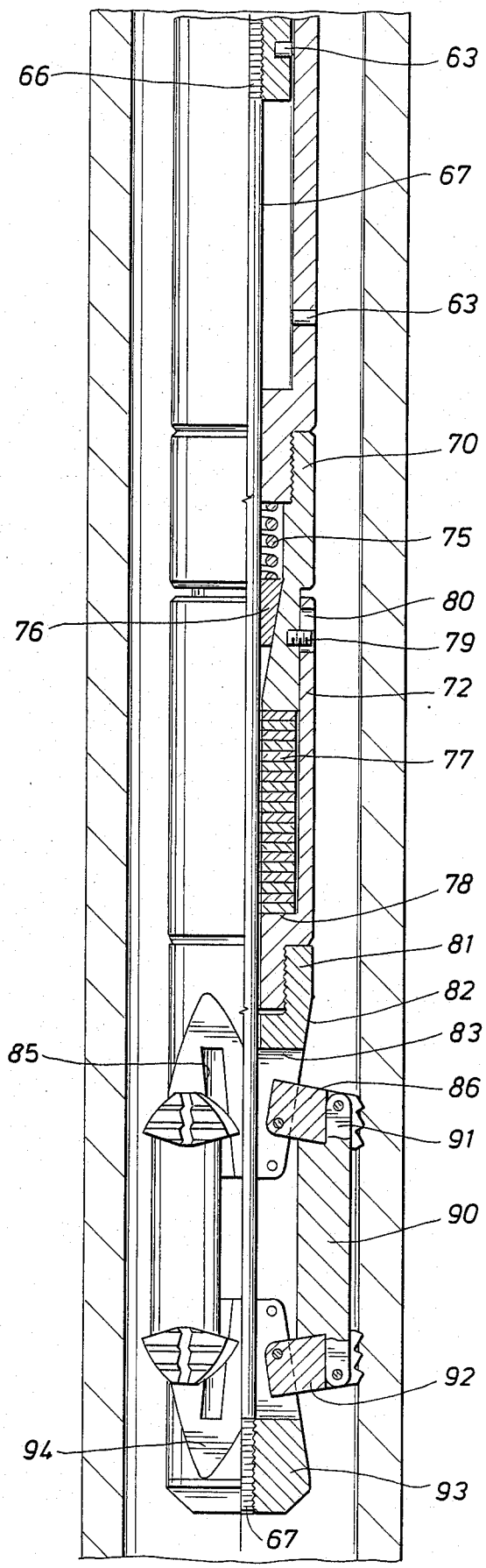
FIG. 2 is a view similar to FIG. 1*d* showing the mechanism after operation wherein the toggle mechanism expands to grasp the wall of the tubing to hold the TTBP in place.

In FIG. 1C, the tube 42 supports a closed set of petal leaves indicated generally at 48. This comprises the petal basket. It is constructed with a circular wedge 49 affixed to a collar 50. The collar 50 is joined by a screw 51 which extends into a slot 52. The slot is in the form of a groove fully encircling the wedge 49 thereby enabling the wedge to rotate relative to member 57 which will be described later. Axial movement is thus forbidden but rotational movement is permitted. This is important in operation to prevent twisting of the collapsed, or folded, petal leaves by rotation during assembly inside the sleeve 15. As will be understood, the petal basket is made up of several thin metal leaves which are constricted in FIG. 1C by the surrounding sleeve 15. This sleeve extends over the petal basket to abut the shoulder 53. When the sleeve 15 is pulled upwardly, it moves away from the petal leaves permitting them to deflect outwardly. The leaves are made of spring metal to deploy into a basket. They deflect outwardly until they engage the surrounding pipe.

Continuing on down the TTBP 10, the tube 42 is perforated with several holes at 55. These holes align adjacent to similar holes 56 in a surrounding sleeve 57 constructed integral with the ring 50 at the bottom of the petal basket.

To review to this juncture, in FIG. 1C, the central tube 42 which encloses the passage 32 is able to move relative to the surrounding tubular member 57 connected with the bottom of the petal basket. This telescoping movement between the two components assists in setting the TTBP 10 for operation as will be described. The central tube 42 is conveniently terminated by threads at 59 to join an extension mandrel 60. This tube continues the passage to lower parts of the TTBP 10 shown in FIG. 1D. On the exterior, the tubular member 57 connects with a surrounding tubular member 61.

Figure 1D:
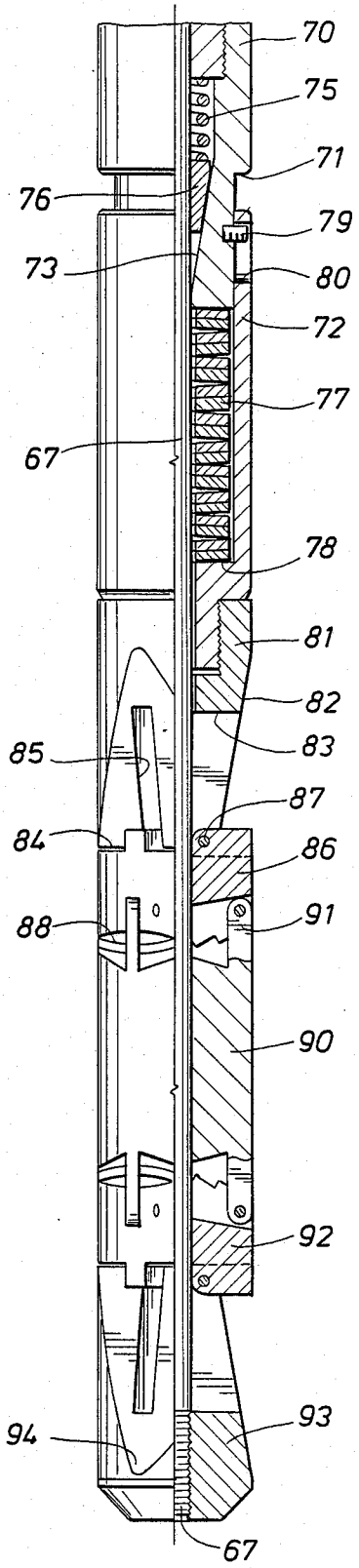

At the top of FIG. 1D it will be observed that the tubular member 61 surrounds the mandrel 60. They undergo telescopic movement wherein the member 61 is forced downwardly around the mandrel 60. The surrounding tubular member 61 supports a shear pin 63. The mandrel 60 is received into a tubular socket 64 and is joined to the socket by means of a fastening pin 65 which is not ordinarily intended to be sheared. The socket 64 supports a downwardly axially aligned threaded opening 66 which permits threaded engagement with an extension rod serving as an additional or extension mandrel. This mandrel is identified by the numeral 67. The mandrel 67 slides through a reduced diameter collar 68 made integral with the tubular member 61. The pin 63 joins these members to prevent telescoping movement until the proper moment, namely shearing during setting of the tool.

The sleeve 68 is narrow, incorporating a skirt on the interior and it threads to a wedge support sleeve 70. The wedge support sleeve 70 is a hollow axial elongate sleeve incorporating an external shoulder 71. This defines a cylindrical surface which receives a spring sleeve 72. It also incorporates an internal wedge shaped surface 73 which is used to accomplish a locking action. The member 70 encloses a cylindrical annular chamber which receives a coil spring 75 bearing against a lock wedge 76. The lock wedge 76 has a mating face which contacts the wedge surface 73. The spring 75 forces the wedge 76 into a locking position which prevents relative upward movement of the surrounding member 70. It is in the up position in FIG. 1D; downward movement will be shown in FIG. 2.

The mandrel 67 is surrounded by a stack of alternating Belleville washers. They are indicated at 77. They abut a shoulder 78 at the lower end and bear against the wedge 70, and are shown in the expanded condition in FIG. 1D. The wedge telescopes under the sleeve 72. It can be moved downwardly as required. The two are held together by a threaded bolt 79 which is received in a slot 80. The slot length tolerates relative telescoping movement. In the up or relaxed condition of FIG. 1D, the Belleville washers are not compressed. The bolt 79 is at the top end of the slot. In FIG. 2 as will be shown, the washers are compressed and the bolt 79 has moved down in the slot 80.

The tubular member 72 is able to move along the central mandrel 67. The mandrel 67 fits loosely on the interior. The tubular member 72 terminates at a threaded connection with a threaded member 81. It has chamfers cut at various locations included one shown at 82. Moreover, lengthwise cuts in the form of slots at 83 define a set of rigid fixed fingers terminating at a shoulder 84. The slot 85 shown in FIG. 1D receives the protruding tab on a connective link 86. The connective link 86 has a tab which is joined at pin 87. The pin anchors the lower corner of the connective link 86. At the opposite end, the connective link is split to define a bifurcated structure. A set of serrations at 88 is formed on the end face of the connective link. As shown in FIG. 1D, they are located away from the surrounding tubing or casing. The connective link 86 is rotatable through approximately 90° of rotation. It has a retracted position as shown, thereby positioning the serrations away from the surrounding tubing or casing. The numeral 90 identifies an intermediate connective link. It has a protruding connective tab 91 which is adapted to be joined in the bifurcated connective link 86. The pivot is located higher to improve toggle action. Moreover, the tab 91 protrudes defining a link which is caught against the connective link in toggle movement. There is a conformity between these two surfaces which enables contact. The connective link 90 connects with a similar link 92. The link 92 can be conveniently constructed to the same dimensions as the link 86. The link 92 is fastened to a tapered sub 93, the sub 93 being threaded to the mandrel extension 67. The mandrel extension is formed with threads on the exterior and has sufficient length to receive the sub 93. The sub 93 has faces cut thereon at 94 to assure conformance with the connective link 92 when it rotates through a specified angle.

While the foregoing discusses the deployment of the components which make up the TTBP 10, a sequence of operation will be described. Perhaps this will assist to convey understanding of the construction and operation of the device. Recalling that the goal is to cure a mixture of sand and cement into a plug free of contamination from well fluids, the TTBP is deployed to support the uncured mixture at a specified elevation while securing the TTBP 10.

OPERATION OF THE PREFERRED EMBODIMENT

Assume that the TTBP 10 is run into a well to a desired depth in a cased well. Assume that there are fluids produced therebelow which might otherwise contaminate the uncured plug. Assume that this tool 10 is placed in the well on a typical running tool able to provide relative motion to the sleeves 13 and 15 as will be described. When the TTBP is lowered to the desired depth in a well on a wireline, the setting tool 10 is then operated. On operation, the setting sleeve 15 is jammed downwardly while holding the mandrel 11 at the upper end. The enclosed components are fixed in location relative to the outer components which are forced downwardly by the setting sleeve 15. Relative downward movement of the sleeve 15 is transferred along the full length of that sleeve against the shoulder 53 (FIG. 1C). This downward movement forces all the equipment including the petal basket 48 relatively downwardly around the central tube 42. This downward movement is conveyed by the tubular members 57 and 61 to the wedge 73 to compress the spring 77. When compressed it bears against the slip assembly 73. A downward force is applied to the slip assembly 73, the toggle links 86, 90 and 92 deflect radially outwardly. The serrations 88 are deployed outwardly until they contact and centralize within the surrounding tubing as shown in FIG. 2. This movement anchors the TTBP 10 against further movement in the well. FIG. 2 shows the slip assembly 73 after expansion, the spring elements 77 being compressed. Locking is achieved by operation of the wedge 76 against the tapered slip surface 73 and mandrel 67. All this motion is shown by comparing FIG. 2 with FIG. 1D. During this operation, the pin 63 is sheared and the bolt 79 moves along the slot 80.

On the downward movement of the exterior parts of the TTBP 10 as described above, a tensile or pulling load is applied to the interior tube 42 and mandrels 60 and 67 by means of the mandrel 11. This axial or tensile load is applied while toggling of the links 86, 90 and 92. Even after setting, the Belleville springs 77 cooperative with the slip assemblies hold the toggle means in the deflected position. Thus, when the setting tool is released the slip means does not release and the toggle means is held in the extended position of FIG. 2.

Shearing of the shear pins 38 is accomplished by upward pulling on the mandrel 11. When the pull is sufficient, the pins 38 are broken to enable the mandrel 11 to move relatively upward. This movement frees the sleeve 13 for upward movement. At this juncture, the setting tool can be retrieved up the well. The setting tool carries with it the sleeves 13 and 15. The two sleeves simply slide up and disengage the TTBP.

The upward pull from the setting tool pulls the outer sleeve 15 away from the TTBP 10. When this sleeve 15 is pulled upwardly, the slip petals, made of spring metal, are released to deflect outwardly. On release, they deploy to the full diameter of the tubing or casing. It will be observed that the sleeve 15 pulls away from the shoulder 53 just below the petal basket 48. As it is pulled up and away from the petal basket, it not only releases the petal basket, but it next releases the centralizer wires 44 to deflect outwardly. They are deflected outwardly and are held in that position by the coil spring 46 therebelow which assures that the centralizer stays engaged with the surrounding tubing or casing. Continued removal of the sleeves 13 and 15 ultimately exposes the fishing neck 16 which is the top end of the TTBP.

The TTBP is anchored in the well with the petal basket deployed. It cannot fall or move because it is held in place by the toggle means and it is centralized in the casing. Upward flow is permitted through the passage 32. The ports 55 and 56 introduce fluid to the flow passage 32. The fluid from below flows upwardly and out through the ports 31 and 33 aligned in FIG. 1A. Indeed, production of fluid from below the TTBP is expedited by use of the flow path including the passage 32.

The next step in operation of this equipment is then to deliver a mixture of sand and cement into the petal basket. As will be understood, the tool shown in the drawings is quite long. It extends above the petal basket by several feet. This region is filled with sand and cement above the petal basket extending upwardly short of the slide valve mechanism including the ports 31 and 33.

The sand and cement is delivered in a suitable quantity to form a plug of adequate length in the casing. Fluid contamination is reduced by provision of the flow path just described. Indeed, the sand and cement is isolated for a period of time, thereby enabling curing whereupon the next sequence of operation is undertaken after curing. Assume that the plug has cured even while fluid flows through the tubing passage 32.

Recall at this moment that the top end of the TTBP is the fishing neck 16. An overshot is then run into the well. The overshot is latched to the fishing neck 16. A measured pull is then taken on the overshot. Recall that the bottom portion of the TTBP is now cemented in place. The plug of cement is several feet in length. Thus, the tubing 42 is anchored in location by the toggle means and cement plug. Recall that the tubing 42 connects ultimately with the plug 18. An upward pull on the overshot is applied to the fishing neck 16. The pull at the fishing neck 16 is increased whereby the shear pin 28 is sheared. There is some slack in the shear pin connection between the pin 28 and the slot 29. This slack is needed at the time of installation through use of the setting tool. Because of the great length of the tool 10 in typical circumstances, there is some elongation and hence, the shear pin 28 preferably connects with the slot 29 of controlled length. Thus, the shear pin 28 is not sheared during setting. Initially, the pin 28 is not sheared while tension is taken on the internal components and a compressive force is applied to the setting sleeve 15 on the exterior. While the shear pin 28 remains intact in that fashion at that preliminary step, at the time of engaging the fishing neck 16 with an overshot, sufficient tension is taken so that the shear pin 28 is now broken. When it breaks, it then releases the equipment at the top end of the TTBP for manipulation of the sleeve valve.

The shear pin 28 is first broken; then slack is provided in the overshot supportive wireline. Usually, this can be observed at the surface by momentary change in wireline loading. Recall that the dogs 25 are pivoted. After the shear pin 28 has been broken, the fishing neck 16 is free to move upwardly a short distance. When it moves up, the surrounding sleeve 22 is likewise pulled upwardly. Prior to breaking the shear pin 28, the spring 24 was not fully compressed. Additional compression occurs because all of the pull from the overshot is delivered to the sleeve 22, further compressing the coil spring 24. As the sleeve 22 slides upwardly, the dogs 25 are released and deflect outwardly under urging of the wedge 23 which forces the dogs outwardly to lock against the shoulder 27. Recall that the fishing neck 16 was held in the engaged position by the enlargement 19 at the bottom end of the fishing neck. This condition is sustained so long as the plug 18 is in the "up" position shown in FIG. 1A. However, upward sliding movement of the outer sleeve 22 is accompanied by relative downward movement of the plug 18 to a point where it is below the enlargement 19. The enlargement 19 was locked in position in FIG. 1A by the plug 18. When the plug 18 is moved relatively downwardly, it pulls so far down into the tool that the enlargement 19 is then free to deflect, thereby causing the collet fingers to deflect radially inwardly. When this occurs, the tool 10 is then released to thereby permit retrieval of the fishing neck 16 and the affixed collet fingers 17. In other words, the enlargement 19 is no longer locked. This then permits the wireline overshot to be retrieved. Successful operation is indicated at the surface by recovery of the fishing neck 16.

The operation just described accomplishes the following movements. The sleeve 22 is locked in the "up" position by the dogs 25 wedging against the shoulder 27. The dogs are held in this position by the wedge 23 on the interior of the dogs. In turn, that holds the sleeve 22 relatively upwardly. This separates the ports 31 from the ports 33. The slide valve operation blocks the passage 32. The passage 32, now blocked, terminates flow by operation of the seals 34 which flank the ports 33. Flow through the TTBP is now plugged. Recall that this flow path was kept open during the plug curing process. It can now be closed permanently. At this juncture, additional sand and cement can be introduced on the top of the cement plug already in place to a depth so that the TTBP is completely covered over. This second batch of curable materials completely covers over the slide valve mechanism and assures that the plug is substantially able to hold in the casing. This completely isolates the cased well below the plug. At this juncture, the bridge plug 10 has accomplished its purpose, thereby now completely anchoring a concrete plug in location. The TTBP 10 is firmly held during and after installation by the toggle means shown in FIG. 1D. The toggle means holds after installation so that the TTBP will not slip, breaking the plug bond in the tubing or casing. This toggle means assures holding even if bottom hole pressures increase markedly after the valve ports 31 and 33 are closed relative to one another.

Going again to FIG. 1C, the threaded connection at 59 should be observed. The larger tubular members 57 and 61 thread together at the same location along the length of the tool. The apparatus shown in FIG. 1C below this threaded connection and all the apparatus shown in FIG. 1D can be used as a separate assembly. It functions with a conventional running tool which provides the telescoping or axial movement for operation. That is, the tubular member 61 must be forced downwardly relative to the central mandrel 60 to accomplish setting motion as described above. Accordingly, through the use of such a running tool, the toggle anchor mechanism can be installed above the TTBP after sand and cement has been poured into the petal basket. This permits the anchor mechanism to be located above the TTBP, so to speak, to hold the plug from above. If desired, two such mechanisms can be spaced above the TTBP. They operate in identical fashion. After installation, the plugging operation can be extended by continuing to add the cementitious material until the additional toggle anchor mechanisms have been completely covered over so that they are encased. When this is done, the completed plug may have an exposed toggle anchor mechanism below the plug and one or two encased therein. This adds substantial gripping force and thereby markedly increases the stability of the plug in the well.

While the foregoing is directed to the preferred embodiment of the through tubing bridge plug as described in detail, the scope will be determined by the claims which follow.

What is claimed is:

1. A method of placing a concrete plug in a tubular member which is located in a well so that well fluids are blocked by the plug and where such well fluids interfere with curing of the concrete plug, the method comprising the steps of:

(a) running into the cased well an elongate bridge plug assembly having an upwardly facing basket with a retracted position and an expanded position adapted to receive and hold curable material for forming a concrete plug;

(b) setting the bridge plug assembly at a desired depth in the cased well by expanding a double pivot, three link toggle means having plural articulated serrated teeth adapted to engage the well tubular member to support the bridge plug assembly against pressure from above or below in the surrounding well tubular member, wherein said toggle means pivots at said pivots to grippingly engage the well tubular member;

(c) operating the bridge plug assembly basket to an expanded position;

(d) placing curable materials in the upwardly facing basket and curing the materials to form concrete;

(e) during curing, forming a well fluid flow path across the bridge plug assembly, the flow path utilizing an upstanding flow pipe selectively opened and closed by a valve means at the upper end thereof;

(f) during curing of the curable materials to form concrete, opening the valve means to enable fluid flow along the flow path; and (g) after curing, closing the valve means to prevent fluid flow along the flow path, thereby completely plugging the cased well.

2. The method of claim 1 wherein the bridge plug assembly supports the upstanding flow pipe above the basket and the upstanding flow pipe supports the valve means at the upper end thereof, and including the steps of opening or closing the valve means as recited at steps (f) and (g) of claim 1 by wireline manipulation of wireline supported tools above the bridge plug assembly.

3. The method of claim 2 wherein the valve means includes a slide valve element for closure of the valve means, and also includes an upstanding fishing neck releasably connected to the valve means for retrieval on being released on closure of the valve means, and including the step of engaging and retrieving the fishing neck to obtain a surface indication that the valve means was closed.

4. The method of claim 1 wherein the upwardly facing basket and the toggle means are supported on the bridge plug assembly by an external telescoping tubular member positioned about an internal tubular member, and wherein said toggle means is radially expanded by applying relative motion to said external and internal tubular members of the bridge plug assembly.

5. The method of claim 4 including lock means between said external and internal tubular members for holding the toggle means in the radially expanded position, and further including the step of forcing the external tubular member axially downwardly relative to the internal tubular member until said lock means is operated to hold the toggle means in an expanded position.

6. The method of claim 1 including selectively opening and closing slide valve means on the bridge plug assembly wherein the slide valve means are opened on deployment of the upwardly facing basket in the well, and including the steps of bailing sand and cement into the basket as the curable materials in the basket to form the plug, and further including the step of operating the slide valve means extending above the cured material, the slide valve means being opened and closed selectively to permit or block fluid flow past the cured plug.

7. The method of claim 1 including a removable sleeve adapted to be supported on a running tool, said sleeve being secured to the bridge plug assembly by means of a shear pin and wherein said sleeve extends over centralizing means on the bridge plug assembly from the top of the bridge plug assembly, and including the method steps of utilizing the running tool to locate the bridge plug assembly at a specified depth in the well followed by the steps of shearing the shear pin and thereafter pulling the sleeve from the bridge plug assembly.

8. The method of claim 7 including a second sleeve covering the upper end of the bridge plug assembly, and including the step of placing a fishing neck in the second sleeve prior to running in a well, and then removing the second sleeve to expose the fishing neck.

9. The method of claim 1 including the additional steps of installing a second toggle means in the well above the bridge plug, setting the toggle means in an expanded position in the well and placing additional curable materials around the second toggle means to extend the plug above the toggle means to encase the second toggle means and thereby enhance the grip of the plug in the well.

10. The method of claim 9 including the step of anchoring the plug by extending the plug fully above the second toggle means.

11. The method of claim 10 including the step of locking the second toggle means by surrounding cement thereabout.

12. The method of claim 11 including the step of positioning the second toggle means above the bridge plug assembly in contact therewith.

13. The method of claim 12 including the step of positioning the second toggle means in the open well after closing the valve means.

14. A bridge plug assembly adapted to be placed in a tubular member well to isolate and controllably block fluid flow thereacross, the assembly comprising:

(a) an elongate flow pipe;

(b) valve means at the top end of said flow pipe;

(c) double pivot, three link toggle means supported by said flow pipe for expansion to engage a surrounding well tubular member;

(d) upwardly foacing basket means supported by said flow pipe having:

(1) a closed and collapsed position around said flow pipe; and (2) an expanded position facing upwardly to receive curable materials therein;

(e) said flow pipe and said valve means defining a flow path from below said basket means to above said basket means wherein said valve means opens or closes the flow path; and (f) first and second co-acting mean supported by said flow path for telescoping movement therebetween for (1) expanding said toggle means to engage the well tubular member;

(2) expanding said basket means; and (3) opening said valve means.

15. The apparatus of claim 14 including first and second concentric sleeves having ports formed therein to define said valve means, said valve means futher including seals cooperative with said concentric sleeves, and also including a passage along said flow pipe to connect with the ports in said valve means.

16. A method of placing a concrete plug in a tubular member which is located in a well so that well fluids are blocked by the plug and where such well fluids interfere with curing of the concrete plug, the method comprising the steps of:

(a) running into the cased well an elongate bridge plug assembly having an upwardly facing basket with a retracted position and an expanded position adapted to receive and hold curable material for forming a concrete plug;

(b) setting the bridge plug assembly at a desired depth in the cased well by expanding a double pivot, three link toggle means having plural articulated serrated teeth adapted to engage the well tubular member to support the bridge plug assembly against pressure from above or below in the surrounding well tubular member, wherein said toggle means pivots at said pivots to grippingly engage the well tubular member;

(c) operating the bridge plug assembly basket to an expanded position;

(d) placing curable materials in the upwardly facing basket and curing the materials to form concrete;

(e) during curing, forming a well fluid flow path across the bridge plug assembly, the flow path utilizing an upstanding flow pipe selectively opened and closed by a valve means at the upper end thereof;

(f) during curing of the curable materials to form concrete, opening the valve means to enable fluid flow along the flow path;

(g) after curing, closing the valve means to prevent fluid flow along the flow path, thereby completely plugging the cased well;

(h) placing an expandable toggle means immediately above the bridge plug;

(i) expanding the toggle means to grip the well;

(j) placing additional curable materials above the bridge plug to fully surround the toggle means so that, after curing, the concrete plug encases the toggle means.

* * * * *